US009842569B2

(12) United States Patent
Kim

(10) Patent No.: US 9,842,569 B2
(45) Date of Patent: Dec. 12, 2017

(54) DISPLAY DEVICE CAPABLE OF GRADUALLY CHANGING LUMINANCE AND GAMMA

(71) Applicant: Samsung Display Co., Ltd., Yongin-si, Gyeonggi-do (KR)

(72) Inventor: Min Weun Kim, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 15/349,857

(22) Filed: Nov. 11, 2016

(65) Prior Publication Data

US 2017/0061929 A1 Mar. 2, 2017

Related U.S. Application Data

(62) Division of application No. 13/693,824, filed on Dec. 4, 2012, now Pat. No. 9,508,290.

(30) Foreign Application Priority Data

Aug. 31, 2012 (KR) ..... 10-2012-0096605

(51) Int. Cl.

| | |
|---|---|
| ***G09G 5/10*** | (2006.01) |
| ***G09G 3/34*** | (2006.01) |
| ***G09G 3/20*** | (2006.01) |

(52) U.S. Cl.

CPC ..... *G09G 5/10* (2013.01); *G09G 3/2092* (2013.01); *G09G 3/3406* (2013.01); *G09G 2310/027* (2013.01); *G09G 2310/0267* (2013.01); *G09G 2310/08* (2013.01); *G09G 2320/0247* (2013.01); *G09G 2320/0626* (2013.01); *G09G 2320/0653* (2013.01); *G09G 2320/0673* (2013.01); *G09G 2320/10* (2013.01); *G09G 2360/144* (2013.01)

(58) Field of Classification Search

CPC ..... G09G 2320/0247; G09G 3/3406; G09G 2360/144; G09G 2320/0673

USPC ..... 345/690

See application file for complete search history.

(56) References Cited

U.S. PATENT DOCUMENTS

| | | | | |
|---|---|---|---|---|
| 2009/0167658 | A1* | 7/2009 | Yamane | G09G 3/3406 345/89 |
| 2010/0141635 | A1 | 6/2010 | Plut | |
| 2011/0298839 | A1 | 12/2011 | Nakanishi | |
| 2012/0032995 | A1 | 2/2012 | Lee | |
| 2013/0093803 | A1 | 4/2013 | Saitoh | |

FOREIGN PATENT DOCUMENTS

| | | | |
|---|---|---|---|
| JP | 2009-180765 | A | 8/2009 |
| KR | 10-2006-0012738 | A | 2/2006 |
| KR | 10-2011-0058352 | A | 6/2011 |
| WO | WO 2012/017899 | A1 | 2/2012 |

* cited by examiner

*Primary Examiner* — Jonathan Blancha
(74) *Attorney, Agent, or Firm* — Knobbe Martens Olson & Bear LLP

(57) ABSTRACT

A display device is disclosed. The display device comprises a display panel whose luminance changes from a start luminance to a target luminance lower than the start luminance and which displays an image, wherein the image comprises a start frame having the start luminance and a start gamma, a target frame having the target luminance and a target gamma, and a plurality of intermediate frames sequentially placed between the start frame and the target frame, where a difference in the luminance of the display panel between adjacent frames is reduced.

7 Claims, 9 Drawing Sheets

| | Fs | F1 | F2 | ... | Fn | Ft |
|---|---|---|---|---|---|---|
| Luminance | Ls | L1 | L2 | ... | Ln | Lt |
| Gamma | Gs | G1 | G2 | ... | Gn | Gt |

DISPLAY DEVICE CAPABLE OF GRADUALLY CHANGING LUMINANCE AND GAMMA

CROSS-REFERENCE TO RELATED APPLICATION(S)

This application is a divisional of application Ser. No. 13/693,824, filed on Dec. 4, 2012, which claims priority from Korean Patent Application No. 10-2012-0096605 filed on Aug. 31, 2012 in the Korean Intellectual Property Office, the disclosures of which are incorporated herein by reference in their entirety.

BACKGROUND

Field

The disclosed technology relates to a display device, and more particularly, to a display device which can adjust the brightness of a display panel.

Description of the Related Technology

As portable display devices (such as notebooks, mobile phones and portable media players (PMPs)) as well as display devices for homes (such as TVs and monitors) become lighter and thinner, various flat panel displays are being used. A flat panel display includes a display panel which displays images. Flat panel displays may be classified into liquid crystal displays, organic electroluminescent displays, and electrophoretic displays according to the type of the display panel.

A display device can control the luminance of an image displayed on a display panel. The luminance of the display panel can be controlled using various methods. For example, the luminance of the display panel can be controlled by a luminance change command received from outside the display device. Alternatively, a light sensor included in the display device may sense ambient brightness and automatically change the luminance of the display panel based on the sensed ambient brightness. To improve the display quality of an image displayed on the display panel, when the luminance of the display panel is changed, the gamma of the display panel may also be changed. For example, when the luminance of the display panel increases, the gamma of the display panel may also increase, thereby reducing saturation.

If the luminance of the display panel sharply changes from a current luminance to a target luminance, flickering can be observed on the display panel, or display quality can be degraded.

SUMMARY OF CERTAIN INVENTIVE ASPECTS

One inventive aspect is a display device including a display panel whose luminance changes from a start luminance to a target luminance lower than the start luminance and which displays an image. The image includes a start frame having the start luminance and a start gamma, a target frame having the target luminance and a target gamma, and a plurality of intermediate frames sequentially placed between the start frame and the target frame, where a difference in the luminance of the display panel between adjacent frames is successively reduced.

Another inventive aspect is a display device including a display panel whose luminance changes from a start luminance to a target luminance higher than the start luminance and which displays an image. The image includes a start frame having the start luminance and a start gamma, a target frame having the target luminance and a target gamma, and a plurality of intermediate frames sequentially placed between the start frame and the target frame, where a difference in the luminance of the display panel between adjacent frames successively increases.

Another inventive aspect is a display device including a display panel whose luminance changes from a start luminance to a target luminance and which displays an image. The image includes a start frame having the start luminance and a start gamma, a target frame having the target luminance and a target gamma, and a plurality of intermediate frames sequentially placed between the start frame and the target frame, where a difference in the luminance of the display panel between adjacent frames is successively reduced when the target luminance is less than the start luminance and successively increases when the target luminance is greater than the start luminance.

BRIEF DESCRIPTION OF THE DRAWINGS

The above and other aspects and features are described with reference to the attached drawings, in which.

DETAILED DESCRIPTION OF CERTAIN INVENTIVE EMBODIMENTS

Embodiments are described with reference to the attached drawings.

Figure 1:
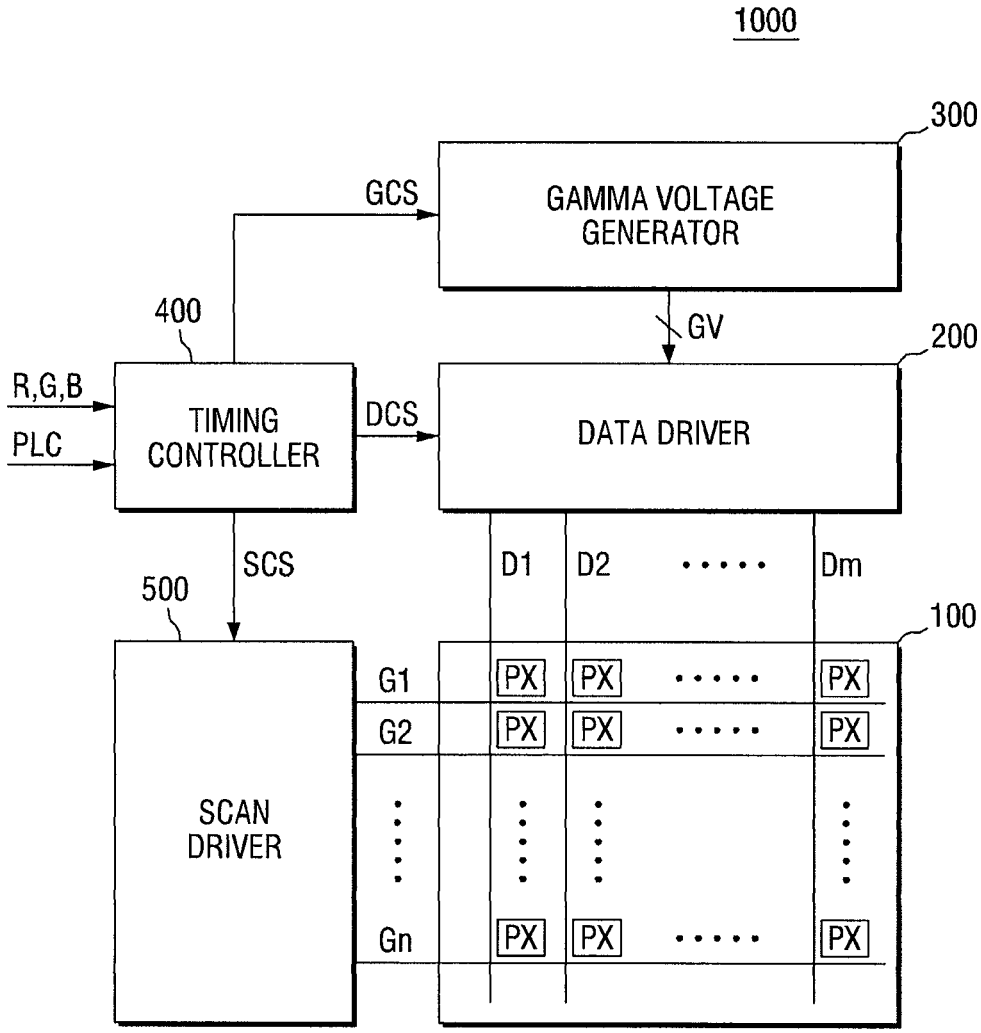
FIG. 1 is a block diagram of a display device according to an embodiment.

FIG. 1 is a block diagram of a display device 1000 according to an embodiment. Referring to FIG. 1, the display device 1000 includes a display panel 100. The display panel 100 may display images. The display panel 100 may be a liquid crystal display panel, an electrophoretic display panel, an organic electroluminescent display panel, or one of various display panels that can display images.

The display panel 100 may include a plurality of pixels PX arranged in a matrix and may display an image by controlling gray levels of the pixels PX. The display panel 100 may receive first through $m^{th}$ data signals D1 through Dm and first through $i^{th}$ scan signals G1 through GI. The first through $m^{th}$ data signals D1 through Dm may include information about the gray levels of the pixels PX. The pixels PX may determine whether to receive the first through $m^{th}$ data signals D1 through Dm based on the first through $i^{th}$ scan signals G1 through GI.

The display panel 100 may have a variable luminance. The luminance of the display panel 100 may be changed by an external manipulation or may be automatically changed according to the setting of the display device 1000. This will be described in more detail later. The luminance of the display panel may generally refer to a global brightness of the display panel and may or may not be related to a particular image being displayed. The luminance of the display panel may correspond, for example, to a brightness of an image displayed with a maximum gray level. The luminance of the display pane can be changed automatically or manually.

The display device 100 may further include a timing controller 400, a scan driver 500, a gamma voltage generator 300, and a data driver 200.

The timing controller 400 may receive image data R, G and B and a panel luminance control signal PLC. The image data R, G and B may include information about a gray level of an image to be displayed on the display panel 100, and the panel luminance control signal PLC may include information about the luminance of the display panel 100. The timing controller 400 may generate a scan control signal SCS, a data control signal DCS and a gamma control signal GCS corresponding to the image data R, G and B and the panel luminance control signal PLC.

The scan driver 500 may receive the scan control signal SCS and generate the first through $i^{th}$ scan signals G1 through GI corresponding to the scan control signal SCS.

A gamma curve is a function which outputs a gray level of an image that is displayed on the panel corresponding to a gray level of image data R, G, and B. The gamma curve may, for example, be used in the equation: $Y=M*(x/M)^g$, where Y is the gray level displayed, M is a maximum gray level, x is the image data R, G, or B, and g is gamma.

The gamma voltage generator 300 may receive the gamma control signal GCS and generate a gamma voltage GV corresponding to the gamma control signal GCS. The gamma control signal GCS may include information about a gamma value and the luminance of the display panel 100. The gamma voltage GV may be a set of voltages corresponding to gray values that an image can have.

The data driver 200 may receive the data control signal DCS and the gamma voltage GV. The data control signal DCS may include information about a gray level of an image. The data driver 200 may generate the first through $m^{th}$ data signals D1 through Dm from the data control signal DCS by referring to the gamma voltage GV.

Figures 2, 3:
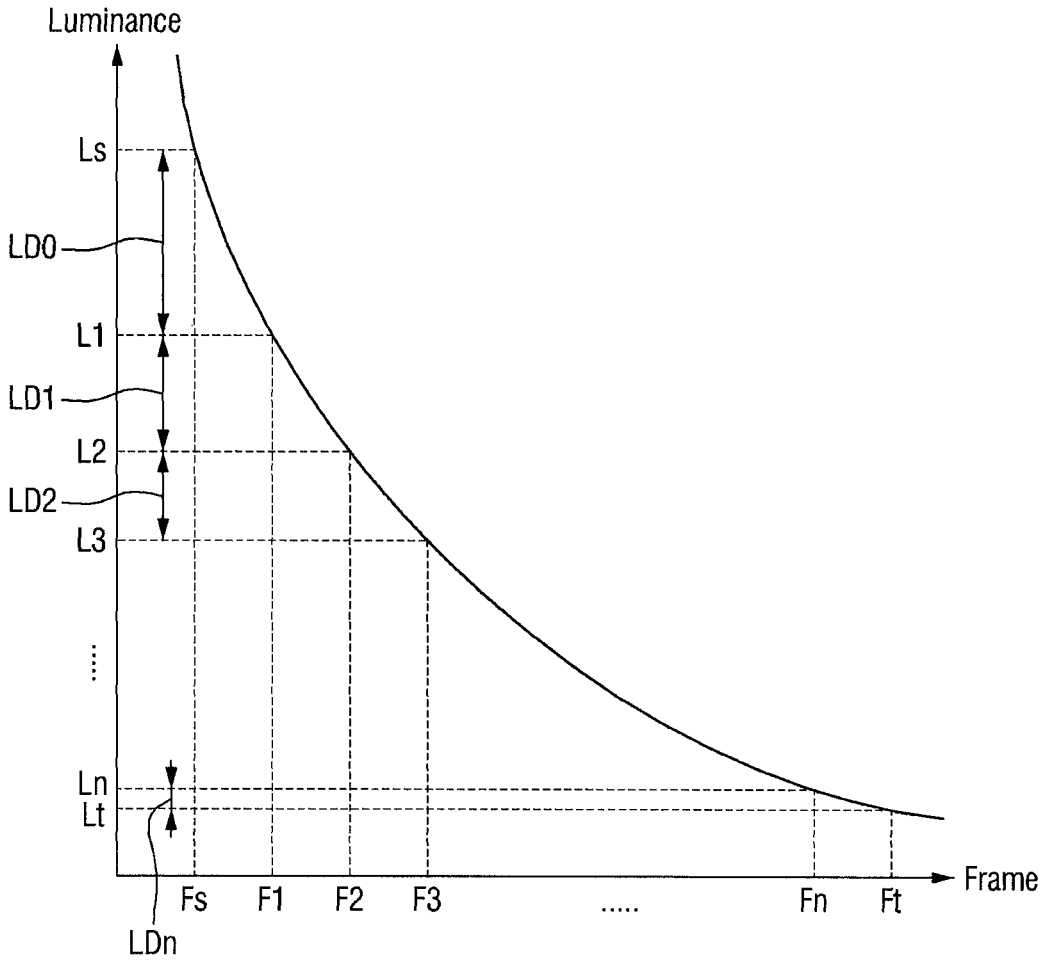
FIG. 2 is a table showing luminances and gammas of frames included in an image according to an embodiment.
FIG. 3 is a graph showing frame and luminance in a case where a target luminance is lower than a start luminance according to an embodiment.

Luminance change of the display panel 100 is described in more detail with reference to FIG. 2. FIG. 2 is a table showing luminances and gammas of frames according to an embodiment.

Referring to FIG. 2, the luminance of the display panel 100 may change from a start luminance Ls to a target luminance Lt. An image displayed on the display panel 100 may include a start frame Fs and a target frame Ft that follows the start frame Fs. The luminance of the display panel 100 in the start frame Fs may be the start luminance Ls, and the luminance of the display panel 100 in the target frame Ft may be the target luminance Ft. The image displayed on the display panel 100 may further include first through $n^{th}$ intermediate frames F1 through Fn. The first through $n^{th}$ intermediate frames F1 through Fn may be located between the start frame Fs and the target frame Ft. The display panel 100 may have first through $n^{th}$ intermediate luminances L1 through Ln in the first through $n^{th}$ intermediate frames F1 through Fn, respectively. Each of the first through $n^{th}$ intermediate luminances L1 through Ln may have a value between the start luminance Ls and the target luminance Lt. If an image includes the first through $n^{th}$ intermediate frames F1 through Fn, whose respective luminances are between the start luminance Ls and the target luminance Lt, between the start frame Fs and the target frame Ft, a sharp change in the luminance of the display panel 100 can be avoided, thus preventing the degradation of display quality.

When the luminance of the display panel 100 is changed, a gamma value may be changed accordingly. For example, as the luminance of the display panel 100 increases, the gamma of the display panel 100 may also increase. Conversely, as the luminance of the display panel 100 decreases, the gamma of the display panel 100 may also decrease. The gamma of the display panel 100 in the start frame Gt may be a target gamma Gt. In addition, the display panel 100 may have first through $n^{th}$ intermediate gammas G1 through Gn in the first through $n^{th}$ intermediate frames F1 through Fn, respectively. Each of the first through $n^{th}$ intermediate gammas G1 through Gn may have a value between the start gamma Gs and the target gamma Gt.

A change in luminance and gamma with respect to frame in a case where the target luminance Lt is lower than the start luminance Ls is described in more detail with reference to FIGS. 3 and 4. FIG. 3 is a graph showing frame and luminance in a case where the target luminance Lt is lower than the start luminance Ls according to an embodiment of the present invention.

Referring to FIG. 3, the luminance (Ls, L1, L2, . . . , Ln, Lt) of the display panel 100 may be successively reduced from the start frame Fs to the target frame Ft. More specifically, a reduction (LD0, LD1, . . . , LDn) in the luminance of the display panel 100 between adjacent frames may be gradually reduced. When the target luminance Lt is lower than the start luminance Ls, if the reduction (LD0, LD1, . . . , LDn) in the luminance of the display panel 100 between adjacent frames is gradually reduced, the luminance of the display panel 100 may change relatively gently at low luminance. Since human eyes are more sensitive to brightness changes at low luminance than at high luminance, if the reduction (LD0, LD1, . . . , LDn) in the luminance of the display panel 100 between adjacent frames is gradual in the case where the target luminance Lt is lower than the start luminance Ls, the perception of the change in the luminance of the display panel 100 by human eyes may be reduced. Accordingly, this can prevent the degradation of image quality due to luminance changes. According to some embodiments, the luminance of the display panel 100 may be reduced exponentially. However, the present invention is not limited thereto.

Figure 4:
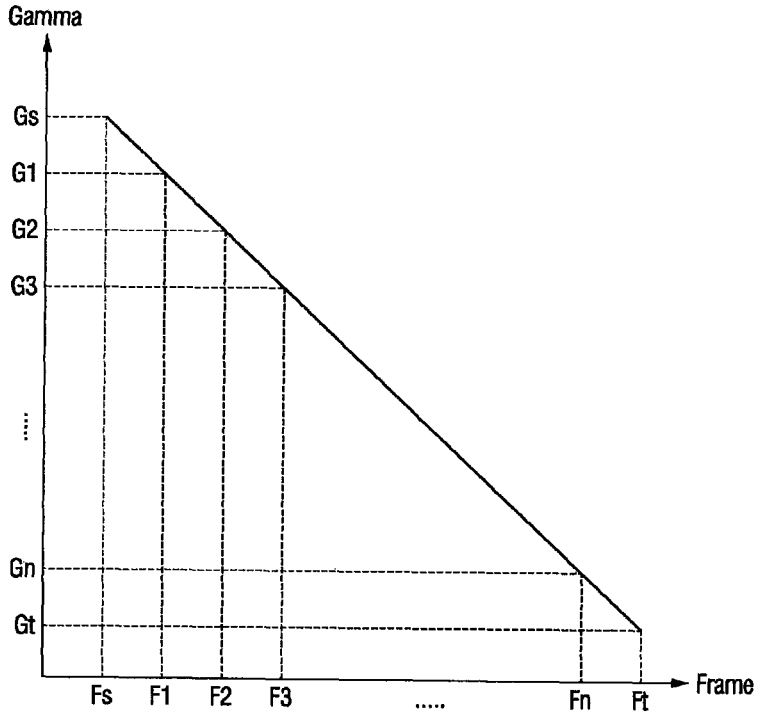
FIG. 4 is a graph showing frame and gamma in a case where the target luminance is lower than the start luminance according to an embodiment.

FIG. 4 is a graph showing frame and gamma in a case where the target luminance Lt is lower than the start luminance Ls according to an embodiment of the present invention. Referring to FIG. 4, the gamma of the display panel 100 may be reduced at an equal rate in the first through $n^{th}$ intermediate frames F1 through Fn between the start frame Fs and the target frame Ft. That is, a difference between the start gamma Gs and the first intermediate gamma G1, a difference between adjacent gammas of the first through $n^{th}$ intermediate gammas G1 through Gn, and a difference between the $n^{th}$ intermediate gamma Gn and the target gamma Gt may all be equal. If x is a natural number in a range of 1 to n, an $x^{th}$ intermediate gamma Gx may be given by Gx=Gs+x*((Gt−Gs)/(n+1)).

Figure 5:
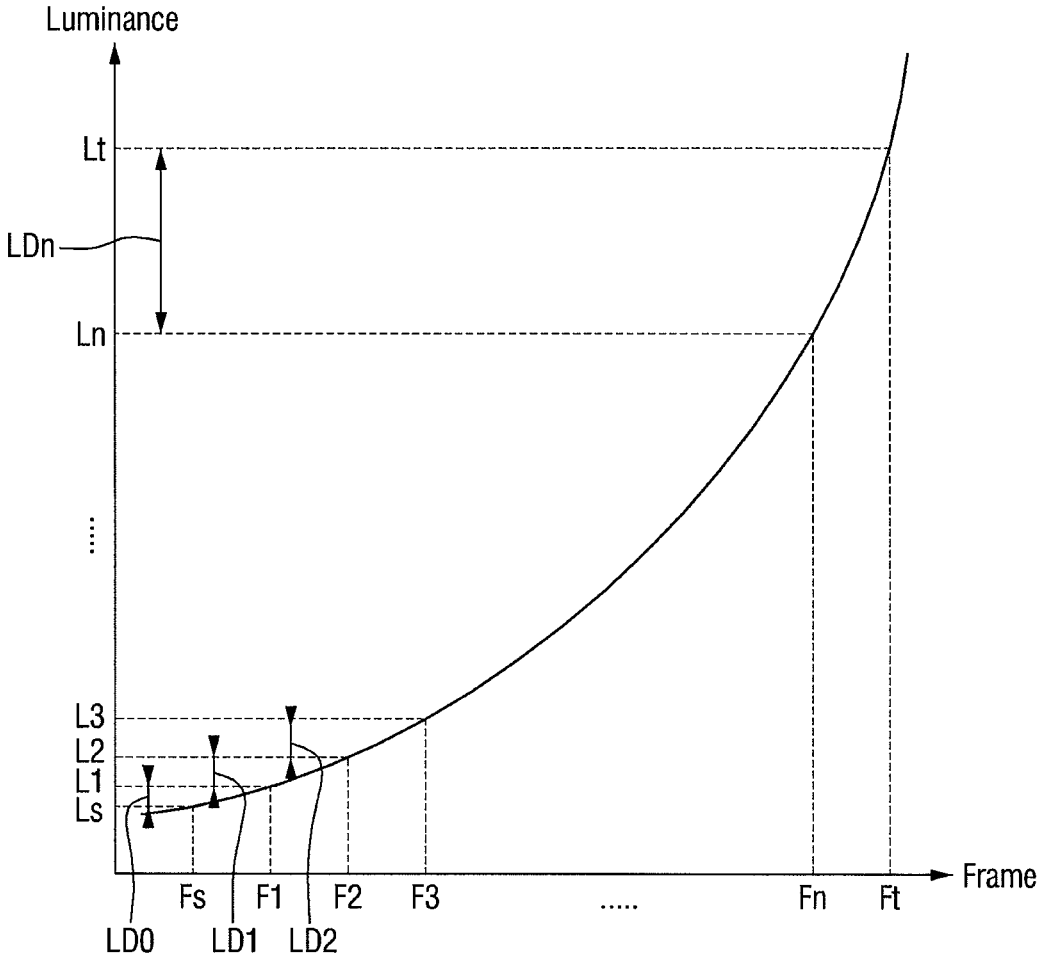
FIG. 5 is a graph showing frame and luminance in a case where the target luminance is higher than the start luminance according to an embodiment.

The change in luminance and gamma with respect to frame in a case where the target luminance Lt is higher than the start luminance Ls will now be described in more detail with reference to FIGS. 5 and 6. FIG. 5 is a graph showing frame and luminance in a case where the target luminance Lt is higher than the start luminance Ls according to an embodiment.

Referring to FIG. 5, the luminance (Ls, L1, L2, . . . , Ln, Lt) of the display panel 100 may successively increase from the start frame Fs to the target frame Ft. More specifically, an increase (LD0, LD1, . . . , LDn) in the luminance of the display panel 100 between adjacent frames may gradually increase. When the target luminance Lt is higher than the start luminance Ls, if the increase (LD0, LD1, . . . , LDn) in the luminance of the display panel 100 between adjacent frames gradually increases, the luminance of the display panel 100 may change relatively gently at low luminance. If the increase (LD0, LD1, LDn) in the luminance of the display panel 100 between adjacent frames gradually increases in the case where the target luminance Lt is higher than the start luminance Ls, perception of a change in the luminance of the display panel 100 by human eyes may be reduced. Accordingly, this can prevent the degradation of image quality due to luminance changes. According to some embodiments, the luminance of the display panel 100 may be reduced exponentially. However, the present invention is not limited thereto.

Figure 6:
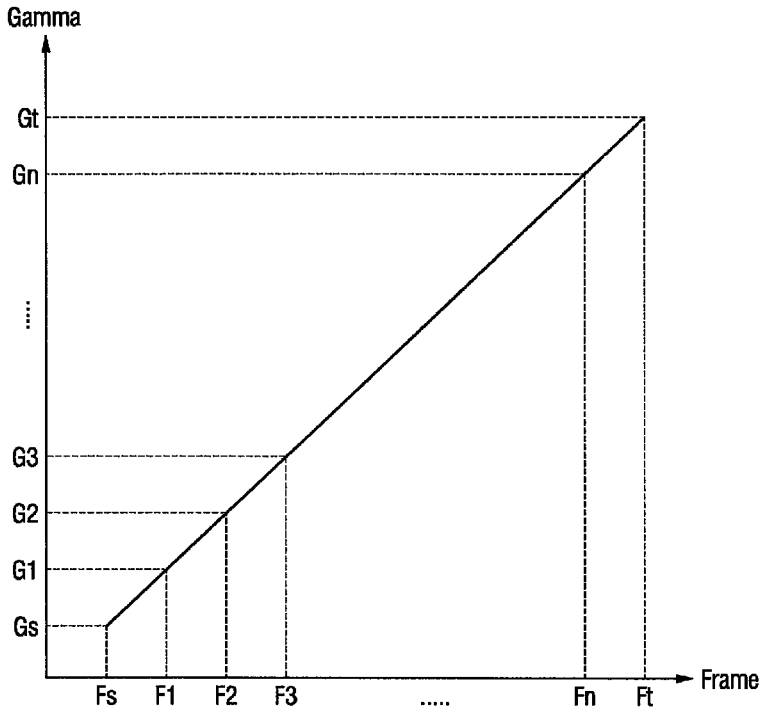
FIG. 6 is a graph showing frame and gamma in a case where the target luminance is higher than the start luminance according to an embodiment.

FIG. 6 is a graph showing frame and gamma in a case where the target luminance Lt is higher than the start luminance Ls according to an embodiment. Referring to FIG. 6, the gamma of the display panel 100 may increase at an equal rate in the first through $n^{th}$ intermediate frames F1 through Fn between the start frame Fs and the target frame Ft. That is, a difference between the start gamma Gs and the first intermediate gamma G1, a difference between adjacent gammas of the first through $n^{th}$ intermediate gammas G1 through Gn, and a difference between the $n^{th}$ intermediate gamma Gn and the target gamma Gt may all be equal. If x is a natural number in a range of 1 to n, an $x^{th}$ intermediate gamma Gx may be given by Gx=Gs+x*((Gt−Gs)/(n+1)).

Figure 7:
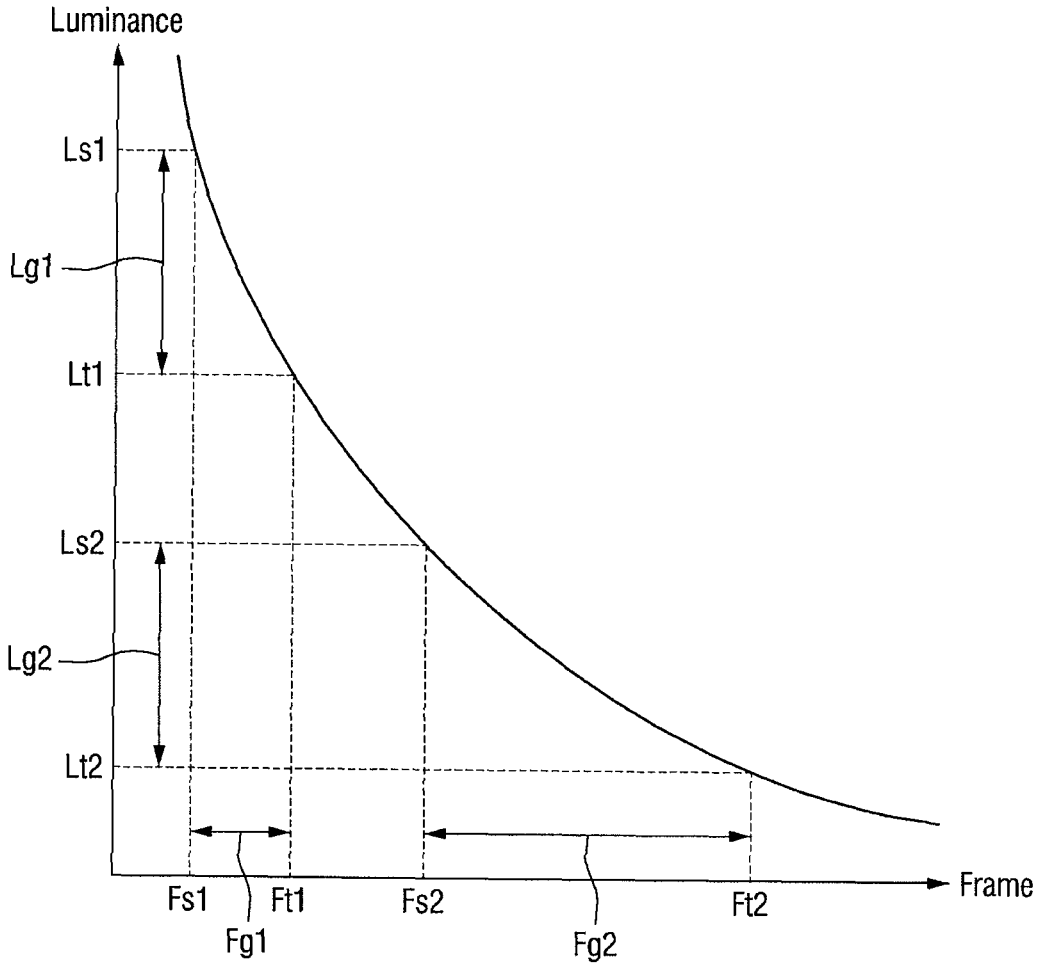
FIG. 7 is a graph showing frame and luminance in a case where the target luminance is lower than the start luminance according to another embodiment.

A method of setting the number of intermediate frames in a case where the target luminance Lt is lower than the start luminance Ls is described with reference to FIG. 7. FIG. 7 is a graph showing frame and luminance in a case where the target luminance Lt is lower than the start luminance Ls according to an embodiment.

Referring to FIG. 7, the luminance of the display panel 100 may be reduced from a first start luminance Ls1 to a first target luminance Lt1 or from a second start luminance Ls2 to a second target luminance Lt2. The second start luminance Ls2 may be lower than the first start luminance Ls1. A difference Lg1 between the first start luminance Ls1 and the first target luminance Lt1 may be equal to a difference Lg2 between the second start luminance Ls2 and the second target luminance Lt2. The luminance of the display panel 100 in a first start frame Fs1 may be the first start luminance Ls1, the luminance of the display panel 100 in a first target frame Ft1 may be the first target luminance Lt1, the luminance of the display panel 100 in a second start frame Fs2 may be the second start luminance Ls2, and the luminance of the display panel 100 in a second target frame Ft2 may be the second target luminance Lt2.

The graph of luminance with respect to frame shows a gradual reduction in luminance. For example, the graph of luminance with respect to frame may be, but is not limited to, a graph showing an exponential reduction in luminance. If the graph of luminance with respect to frame shows a gradual reduction in luminance, a difference Fg1 between the first start frame Fs1 and the first target frame Ft1 may be less than a difference Fg2 between the second start frame Fs2 and the second target frame Ft2. The number of intermediate frames placed between a start frame and a target frame may be determined by a difference between the start frame and the target frame in FIG. 7. Therefore, a greater number of intermediate frames may be placed between the start frame and the target frame when the luminance of the display panel 100 changes from the second start luminance Ls2 lower than the first start luminance Ls1 to the second target luminance Lt2 than when the luminance of the display panel 100 changes from the first start luminance Ls1 to the first target luminance Lt1. If a greater number of intermediate frames are placed between the start frame and the target frame when the luminance of the display panel 100 changes from the second start luminance Ls2 lower than the first start luminance Ls1 to the second target luminance Lt2 than when the luminance of the display panel 100 changes from the first start luminance Ls1 to the first target luminance Lt1, an image may include more intermediate frames when the luminance of the display panel 100 changes at relatively low luminance. This ensures gentle changes in luminance, thereby preventing the degradation of display quality due to the luminance changes.

In FIG. 7, the first start frame Fs1 precedes the second start frame Fs2, and the first target frame Ft1 precedes the second target frame Ft2. However, the order of frames shown in FIG. 7 may be valid only between the first start frame Fs1 and the first target frame Ft1 and between the second start frame Fs2 and the second target frame Ft2. That is, the second start frame Fs2 can precede the first start frame Fs1, and the second target frame Ft2 can precede the first target frame Ft1.

Figure 8:
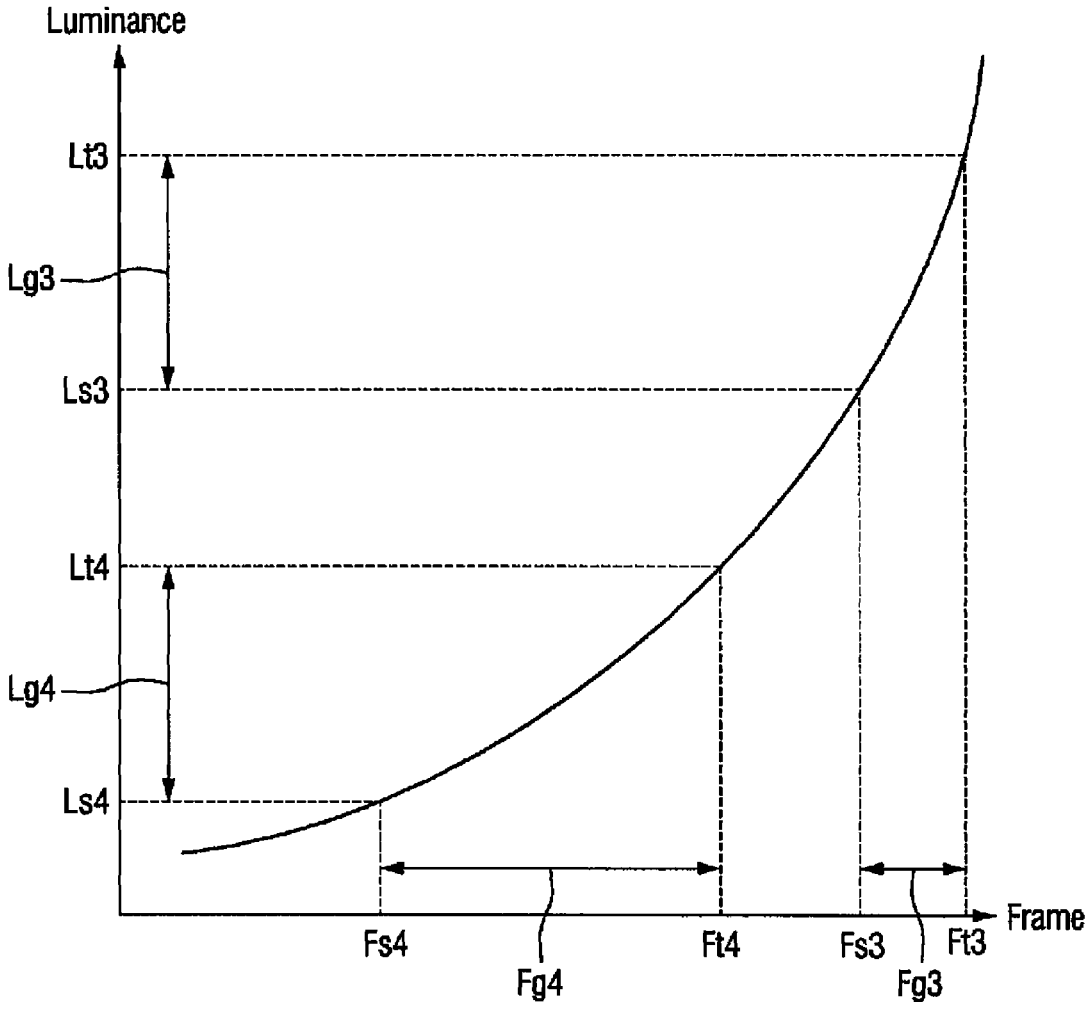
FIG. 8 is a graph showing frame and luminance in a case where the target luminance is higher than the start luminance according to another embodiment.

A method of setting the number of intermediate frames in a case where the target luminance Lt is higher than the start luminance Ls is described with reference to FIG. 8. FIG. 8 is a graph showing frame and luminance in a case where the target luminance Lt is higher than the start luminance Ls according to an embodiment.

Referring to FIG. 8, the luminance of the display panel 100 may increase from a third start luminance Ls3 to a third target luminance Lt3 or from a fourth start luminance Ls4 to a fourth target luminance Lt4. The fourth start luminance Ls4 may be lower than the third start luminance Ls3. A difference Lg3 between the third start luminance Ls3 and the third target luminance Lt3 may be equal to a difference Lg4 between the fourth start luminance Ls4 and the fourth target luminance Lt4. The luminance of the display panel 100 in a third start frame Fs3 may be the third start luminance Ls3, the luminance of the display panel 100 in a third target frame Ft3 may be the third target luminance Lt3, the luminance of the display panel 100 in a fourth start frame Fs4 may be the fourth start luminance Ls4, and the luminance of the display panel 100 in a fourth target frame Ft4 may be the fourth target luminance Lt4.

The graph of luminance with respect to frame may be show a gradual increase in luminance. For example, the graph of luminance with respect to frame may be, but is not limited to, showing an exponential increase in luminance. If the graph of luminance with respect to frame shows a gradual increase in luminance, a difference Fg3 between the third start frame Fs3 and the third target frame Ft3 may be less than a difference Fg4 between the fourth start frame Fs4 and the fourth target frame Ft4. The number of intermediate frames placed between a start frame and a target frame may be determined by a difference between the start frame and the target frame in FIG. 8. Therefore, a greater number of intermediate frames may be placed between the start frame and the target frame when the luminance of the display panel 100 changes from the fourth start luminance Ls4 lower than the third start luminance Ls3 to the fourth target luminance Lt4 than when the luminance of the display panel 100 changes from the third start luminance Ls3 to the third target luminance Lt3. If a greater number of intermediate frames are placed between the start frame and the target frame when the luminance of the display panel 100 changes from the fourth start luminance Ls4 lower than the third start luminance Ls3 to the fourth target luminance Lt4 than when the luminance of the display panel 100 changes from the third start luminance Ls3 to the third target luminance Lt3, an image may include more intermediate frames when the luminance of the display panel 100 changes at relatively low luminance. This ensures gentle changes in luminance, thereby preventing the degradation of display quality due to the luminance changes.

In FIG. 8, the fourth start frame Fs4 precedes the third start frame Fs3, and the fourth target frame Ft4 precedes the third target frame Ft3. However, the order of frames shown in FIG. 8 may be valid only between the third start frame Fs3 and the third target frame Ft3 and between the fourth start frame Fs4 and the fourth target frame Ft4. That is, the third start frame Fs3 can precede the fourth start frame Fs4, and the third target frame Ft3 can precede the fourth target frame Ft4.

Figure 9:
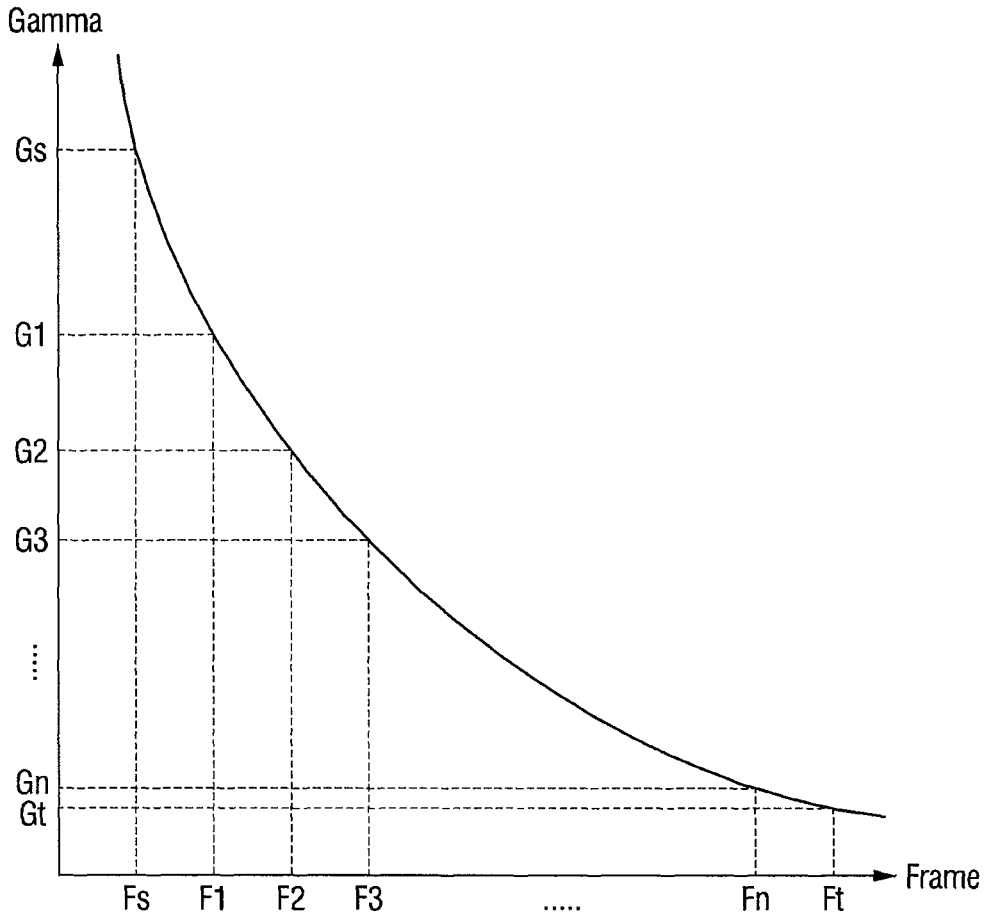
FIG. 9 is a graph showing frame and gamma in a case where the target luminance is lower than the start luminance according to another embodiment.

Gamma changes in intermediate frames according to another embodiment is described with reference to FIGS. 9 and 10. FIG. 9 is a graph showing frame and gamma in a case where the target luminance Lt is lower than the start luminance Ls according to another embodiment.

Referring to FIG. 9, a reduction in gamma between adjacent frames from the start frame Fs to the target frame Ft may be gradually reduced. In the current embodiment, a graph of the change in luminance with respect to frame in the case where the target luminance Lt is lower than the start luminance Ls may be substantially identical to the graph of FIG. 3. Therefore, if the reduction in gamma between adjacent frames from the start frame Fs to the target frame Ft is gradually reduced, the gamma of the display panel 100 may change more gently at low luminance than at high luminance. Since human eyes are more sensitive to changes in an image at low luminance than at high luminance, if the gamma of the display panel 100 changes more gradually at low luminance, perception of changes in the image caused by gamma changes by human eyes may be less. Accordingly, this can prevent the degradation of display quality due to luminance and gamma changes. According to some embodiments, if x is a natural number in a range of 1 to n, an $x^{th}$ intermediate gamma Gx may be given by $Gx=Gs+x*((Gt-Gs)/(n+1))*(\log_{(n+1)}x)$.

Figure 10:
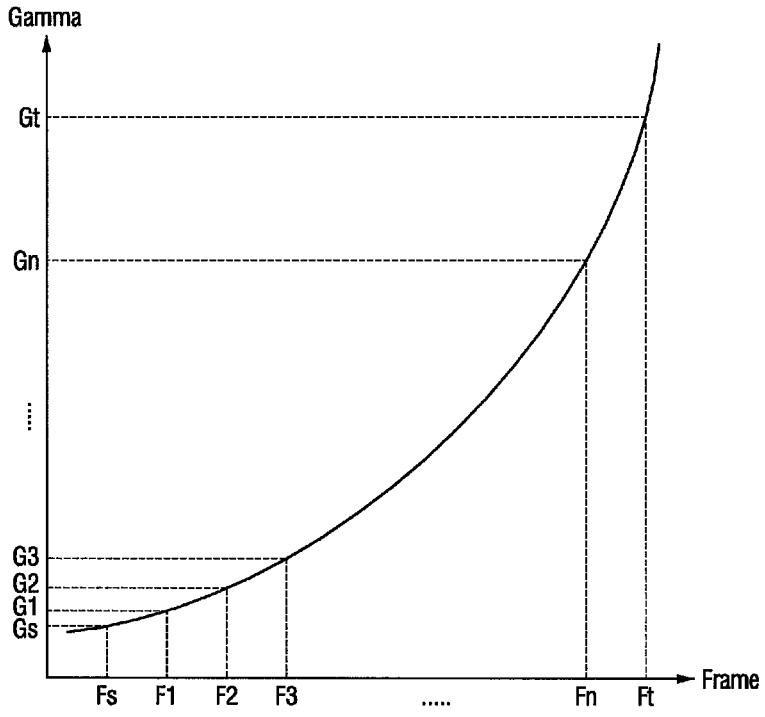
FIG. 10 is a graph showing frame and gamma in a case where the target luminance is higher than the start luminance according to another embodiment.

FIG. 10 is a graph showing frame and gamma in a case where the target luminance Lt is higher than the start luminance Ls according to another embodiment.

Referring to FIG. 10, an increase in gamma between adjacent frames from the start frame Fs to the target frame Ft may gradually increase. In the current embodiment, a graph of the change in luminance with respect to frame in the case where the target luminance Lt is higher than the start luminance Ls may be substantially identical to the graph of FIG. 5. Therefore, if the increase in gamma between adjacent frames from the start frame Fs to the target frame Ft gradually increases, the gamma of the display panel 100 may change more gradually at low luminance than at high luminance. Since human eyes are more sensitive to changes in an image at low luminance than at high luminance, if the gamma of the display panel 100 changes more gradually at low luminance, perception of changes in the image caused by gamma changes by human eyes may be less. Accordingly, this can prevent the degradation of display quality due to luminance and gamma changes. According to some embodiments, if x is a natural number in a range of 1 to n, an $x^{th}$ intermediate gamma Gx may be given by $Gx=Gs+x*((Gt-Gs)/(n+1))*(\log_{(n+1)}x)$.

Embodiments of the present invention provide various advantages, such as those that follow. A display device which can maintain display quality even when the luminance of a display panel changes can be provided. In addition, the luminance of the display panel is changed more gently at low luminance, thereby preventing the degradation of display quality.

The effects of the present invention are not restricted to those set forth herein. It should be understood that the exemplary embodiments described herein should be considered in a descriptive sense only and not for purposes of limitation. Descriptions of features or aspects within each embodiment should typically be considered as available for use as or with other similar features or aspects in other embodiments.

What is claimed is:

1. A display device comprising a display panel whose luminance changes from a start luminance to a target luminance lower than the start luminance and which displays an image, wherein the image comprises:

a start frame having the start luminance and a start gamma;

a target frame having the target luminance and a target gamma; and a plurality of intermediate frames sequentially placed between the start frame and the target frame, wherein a difference in the luminance of the display panel between adjacent frames is successively reduced, wherein the start gamma is greater than the target gamma, the intermediate frames comprise first through n-th intermediate frames, the first through n-th intermediate frames respectively have first through n-th intermediate gammas, and each of the first through n-th intermediate gammas has a value between the start gamma and the target gamma, and wherein a difference in gamma between adjacent frames of the first through n-th intermediate frames is reduced.

2. The display device of claim 1, wherein if x is a natural number in a range of 1 to n, the gamma of the start frame is Gs, the target gamma is Gt, and the gamma of an x-th intermediate frame is Gx, $Gx=Gs+x*((Gt-Gs)/(n+1))*(\log_{(n+1)}x)$.

3. A display device comprising a display panel whose luminance changes from a start luminance to a target luminance lower than the start luminance and which displays an image, wherein the image comprises:

a start frame having the start luminance and a start gamma;

a target frame having the target luminance and a target gamma; and a plurality of intermediate frames sequentially placed between the start frame and the target frame, wherein a difference in the luminance of the display panel between adjacent frames is successively reduced, and wherein the number of intermediate frames included in the image corresponds to the luminance such that the number of intermediate frames is less if the luminance of the display panel is less.

4. A display device comprising a display panel whose luminance changes from a start luminance to a target luminance higher than the start luminance and which displays an image, wherein the image comprises:

a start frame having the start luminance and a start gamma;

a target frame having the target luminance and a target gamma; and a plurality of intermediate frames sequentially placed between the start frame and the target frame, wherein a difference in the luminance of the display panel between adjacent frames successively increases, wherein the start gamma is less than the target gamma, the intermediate frames comprise first through n-th intermediate frames, the first through n-th intermediate frames respectively have first through n-th intermediate gammas, and each of the first through n-th intermediate gammas has a value between the start gamma and the target gamma, and wherein a difference in gamma between adjacent frames of the first through n-th intermediate frames increases.

5. The display device of claim 4, wherein if x is a natural number in a range of 1 to n, the gamma of the start frame is Gs, the target gamma is Gt, and the gamma of an x-th intermediate frame is Gx, $Gx=Gs+x*((Gt-Gs)/(n+1))*(\log_{(n+1)}x)$.

6. A display device comprising a display panel whose luminance changes from a start luminance to a target luminance higher than the start luminance and which displays an image, wherein the image comprises:

a start frame having the start luminance and a start gamma;

a target frame having the target luminance and a target gamma; and a plurality of intermediate frames sequentially placed between the start frame and the target frame, wherein a difference in the luminance of the display panel between adjacent frames successively increases, wherein the start gamma is less than the target gamma, the intermediate frames comprise first through n-th intermediate frames, the first through n-th intermediate frames respectively have first through n-th intermediate gammas, and each of the first through n-th intermediate gammas has a value between the start gamma and the target gamma, and wherein the number of intermediate frames included in the image corresponds to the luminance such that the number of intermediate frames is less if the luminance of the display panel is less.

7. A display device comprising a display panel whose luminance changes from a start luminance to a target luminance and which displays an image, wherein the image comprises:

a start frame having the start luminance and a start gamma;

a target frame having the target luminance and a target gamma; and a plurality of intermediate frames sequentially placed between the start frame and the target frame, wherein a difference in the luminance of the display panel between adjacent frames is successively reduced when the target luminance is less than the start luminance and successively increases when the target luminance is greater than the start luminance, wherein the intermediate frames comprise first through n-th intermediate frames, the first through n-th intermediate frames respectively have first through n-th intermediate gammas, each of the first through n-th intermediate gammas has a value between the start gamma and the target gamma, the first through n-th intermediate gammas are successively reduced when the target luminance is lower than the start luminance, and the first through n-th intermediate gammas successively increase when the target luminance is higher than the start luminance.

* * * * *